United States Patent [19]

Mahon et al.

[11] Patent Number: 4,827,460

[45] Date of Patent: May 2, 1989

[54] BI-DIRECTIONAL SETTING OF A PROGRAMMER TIMER

[75] Inventors: Joseph J. Mahon, Libertyville; Robert K. Aigner, Chicago, both of Ill.

[73] Assignee: Eaton Corporation, Cleveland, Ohio

[21] Appl. No.: 247,816

[22] Filed: Sep. 22, 1988

[51] Int. Cl.[4] ..... G04F 8/00; H01H 43/00

[52] U.S. Cl. ..... 368/113; 200/38 R

[58] Field of Search ..... 200/35 R, 36 R, 38 R, 200/38 A, 38 F, 38 FA, 38 FB, 38 D, 38 DA; 368/107-113

[56] References Cited

U.S. PATENT DOCUMENTS 4,060,702 11/1977 Linn ..... 200/38 R
4,346,271 8/1982 Cushing ..... 200/38 R
4,523,062 6/1985 Mahon ..... 200/35 R
4,629,845 12/1986 Mahon ..... 200/35 R
4,649,239 3/1987 Duve ..... 200/38 R

*Primary Examiner*—Vit W. Miska
*Attorney, Agent, or Firm*—R. A. Johnston

[57] ABSTRACT

A programmer/timer for an appliance of the type having a rotatable program cam advanced by an oscillating pawl engaging a ratchet wheel for actuating at least one appliance function switch. A shaft is provided for enabling user positioning of the cam after limited rotational lost-motion for selecting the program interval. An annular member having a conical cam surface is received over the shaft and is helically cammed to the shaft. During the limited lost-motion rotation of the shaft, the collar moves axially and the conical cam surface lifts the pawl from the ratchet thereafter enabling user rotation of the program cam for positioning same for program interval selection.

8 Claims, 3 Drawing Sheets

BI-DIRECTIONAL SETTING OF A PROGRAMMER TIMER

BACKGROUND OF THE INVENTION

The present invention relates to electromechanical programmer/timers for use in controlling the program functions of an electrically operated appliance. Timers of this type are commonly employed for sequentially controlling the functions of clothes washing machines, dish washers and clothes driers during a user-selected program interval. Typically, the appliance user rotates a selector knob, having a pointer, to a desired dial position for selecting the length of the appliance operating program interval.

In appliance programmer timers, employing a cam drum rotatable for sequentially actuating a plurality of electrical switches for controlling the appliance functions during the program, one of the more widely used techniques for advancing the cam drum is that of oscillating an advance pawl contacting peripheral ratchet teeth provided on the cam drum. Typically, in ratchet and pawl cam advance mechanisms, the leading edge of the ratchet teeth has a greater slant than the trailing edge to permit the pawl to ramp over the tooth on the pawl return stroke and drive against the trailing edge of the tooth on the forward stroke for advancing the ratchet. Such an arrangement thus renders the cam drum capable of user rotation in a forward direction only where the pawl can be "dragged" or ramped over the ratchet teeth during user rotation for initially positioning the cam drum and selection of the desired program interval. However, reverse rotation of the cam drum by the user for program interval selection is precluded by the pawl point being wedged into the base of the ratchet teeth by virtue of the generally radial or reverse incline slope of the trailing edge of the ratchet teeth.

This arrangement of pawl and ratchet advanced appliance programmer/timer cam drums has been found to be somewhat inconvenient for user Program interval selection because the dial must often be rotated nearly a full revolution in order to obtain the desired program interval setting. Thus, it has been desired to find a way or means of enabling bi-directional rotation of the user selection knob employed on an electromechanical appliance programmer/timer having a pawl and ratchet advanced cam drum.

SUMMARY OF THE INVENTION

The present invention provides an electromechanical programmer/timer for an electrically operated appliance and has a cam drum advanced in step-by-step fashion by an oscillating Pawl contacting a toothed ratchet. A user selection knob is attached to a shaft which has thereon engagement means engaging the cam drum and ratchet in limited lost motion rotary engagement for enabling the user to select the initial position of the cam drum and ratchet for determining the desired program interval. An axially movable conically tapered release cam collar is received over the shaft and disposed to be helically camed for axial movement by the engagement means on the shaft during the limited lost motion rotation of the shaft. The axial movement of the collar causes the tapered surface to engage and lift the ratchet advance pawl out of engagement with the ratchet teeth to thereafter permit bi-directional rotation of the cam by the user.

The present invention also optionally employs ratchet teeth of larger diameter for a portion of the ratchet periphery with the remaining teeth having a lesser root diameter. A masking ratchet having intermittent deep notches is provided for permitting engagement of the advance pawl with the lesser diameter teeth only during selected multiples of its stroke for providing a reduced rate of advancement when the pawl drops into the deep notches.

The present invention thus provides a solution to the above-described problem by providing a pawl and ratchet advanced cam drum for sequentially actuating a plurality of electrical switches in an electromechanical programmer/timer and yet provides for user release of the advance pawl to permit bi-directional rotation of the cam drum for ease of initial program interval selection.

DETAILED DESCRIPTION

Figure 1:
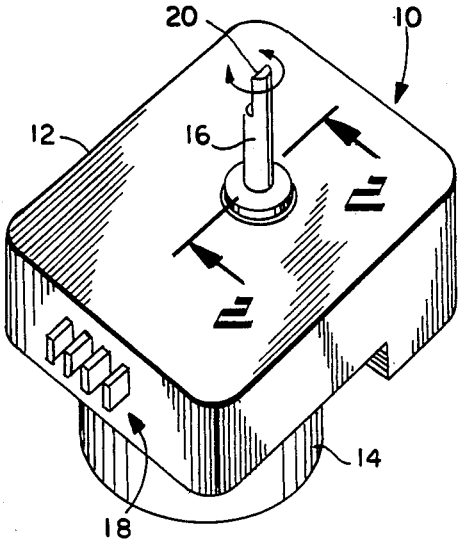
FIG. 1 is a somewhat perspective view of the programmer/timer assembly of the present invention.

Referring to FIG. 1, the programmer/timer assembly of the present invention is indicated generally at 10 as having a housing 12 with a drive motor 14 attached thereto and a shaft 16 extending from the housing and adapted to have a selector knob (not shown) attached thereon for user rotation of the shaft. Suitable electrical connecting terminals indicated generally at 18 are provided for external electrical connection of the assembly to the function circuits of an appliance and for providing power to the motor.

Figure 4:
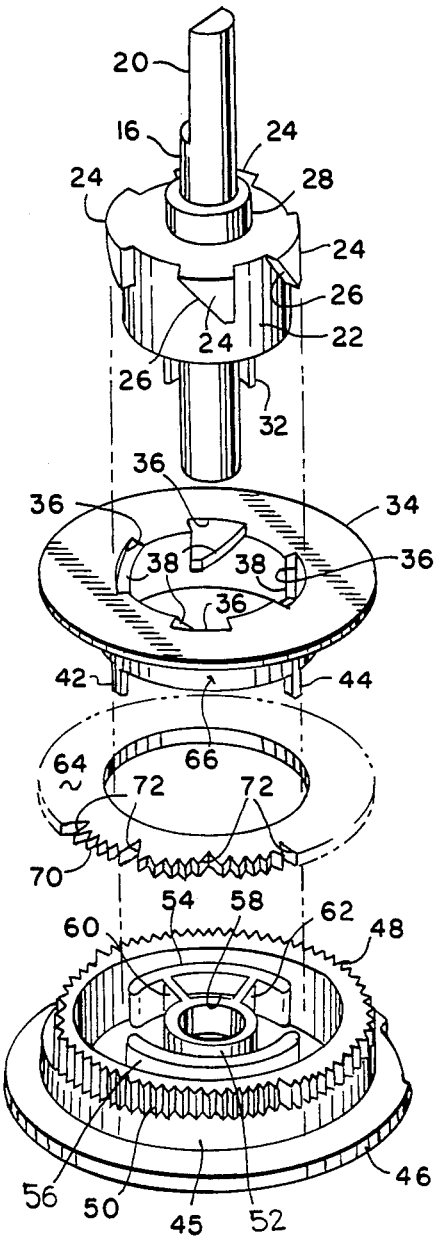
FIG. 4 is a somewhat perspective exploded view of the cam drum on a shaft, axially movable annular cam member and masking ratchet.
Figure 2:
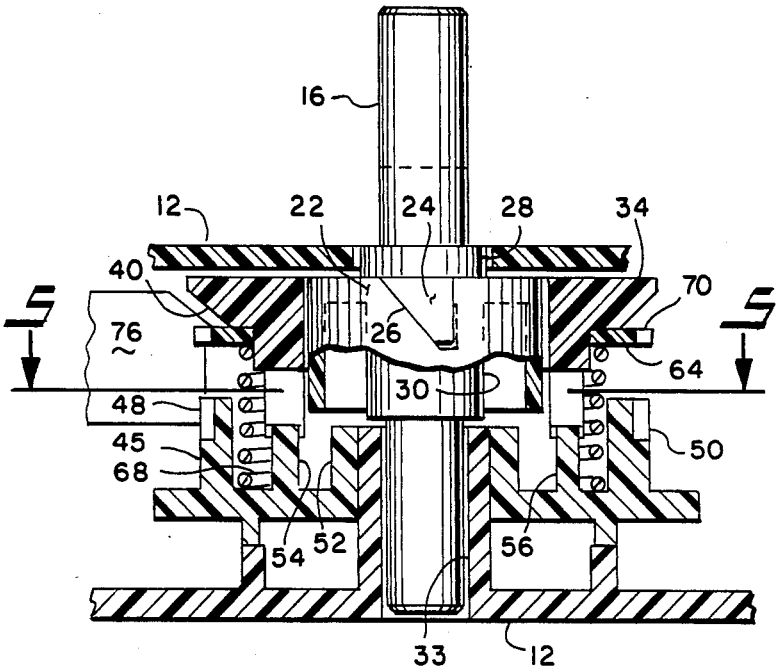
FIG. 2 is an enlarged portion of a section view taken along section-indicating lines 2—2 of FIG. 1.
Figure 3:
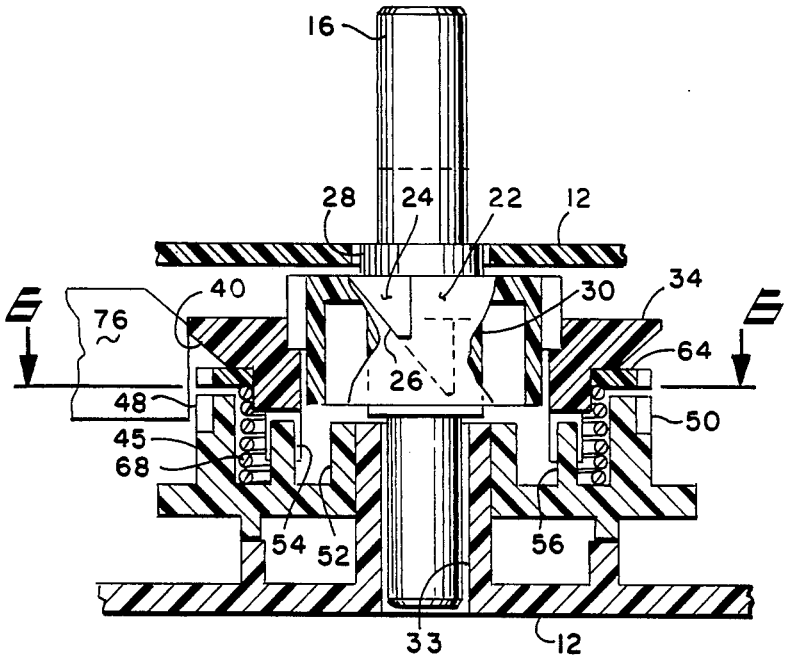
FIG. 3 is a view similar to FIG. 2 illustrating the mechanism of FIG. 2 rotated to a position lifting the advance pawl from the ratchet.

Referring to FIGS. 2, 3 and 4, shaft 16 has a flattened portion 20 provided thereon for enabling user rotation of the shaft. A larger diameter cylindrical portion 22 is provided in the central region of the shaft 16; and, the enlarged portion 22 has provided thereon a plurality of circumferencially spaced lugs 24 each of which has thereon a generally helically configured camming surface 26. A second smaller cylindrical diameter portion is provided on shaft 16 integrally therewith and has a bearing surface 28 provided thereon for journaling in the housing 12.

The larger cylindrical portion 22 has a generally hollow configuration and has a central hub portion 30 with an axially extending lug 32 provided on the rim thereof. In the presently preferred practice, the hub 30 is generally the same diameter as the bearing surface 28. The lower end of shaft 16 is journaled in a suitable boss or cup 33 provided on the lower wall of housing 12.

An annular release cam member 34 is received over shaft 16 and has a plurality of recesses 36 disposed about the inner periphery thereof in circumferencially spaced arrangement. Each of the recesses 36 is shaped complementary to the shape of lugs 24; and, the recesses 36 each have provided therein a helical camming surface 38 which is configured for axial sliding engagement with one of the surfaces 26 on the shaft 16. Annular member 34 has disposed about the periphery thereof a conically tapered release cam surface 40, the function of which will be described hereinafter in greater detail.

Annular member 34 has provided thereon, in diametrally oppositely disposed arrangement, a pair of axially extending lugs 42, 44 for preventing rotation of the member 34 as will hereinafter be described.

A program cam drum member 45 is provided having at least one switch-actuating cam track 46 provided thereon and which is operative upon rotation of the program cam drum to effect actuation and deactuation of the appliance function switch (not shown). The program cam drum 45 also has provided integrally therewith about the periphery thereof a segment of ratchet teeth 48 which have a root diameter greater than the major diameter of the teeth 50 provided about the remaining portion of the periphery.

Drum 45 has a generally hollow configuration with a central hub 52 which is received over the boss 33 provided in the housing; and, the hub 52 is journalled about the outer periphery of the boss 32. A pair of semi-cylindrical ribs 54, 56 are preferably integrally formed on the inner face of the drum and extend axially therefrom and in generally concentric relationship with hub 52 in diametrally oppositely disposed arrangement. The spaces between the ends of ribs 54, 56 have received therein in axially sliding engagement, the lugs 42, 44 provided on the annular cam member 34. The axial lug 32 provided on the shaft 16 engages a correspondingly shaped accurate recess 58 formed by a pair of circumferentially spaced radial ribs 60, 62 extending radially between the hub 52 and the rib 54 in circumferentially spaced arrangement. In the presently preferred practice, the radial ribs 60, 62 are disposed to subtend a central arc a few degrees greater than the central are subtended by the lug 32 to permit a desired limited amount of rotational lost motion between the edges of lug 32 and the ribs 60, 62.

A masking ratchet 64 is received over a cylindrical surface 66 provided on the annular release cam 34. The masking ratchet 64 is journalled thereon and urged upwardly against the shoulder formed by the intersection of the cylindrical surface 66 and release cam surface 40 by a suitable spring, indicated by reference numeral 68 in FIGS. 2 and 3. The masking ratchet 64 has teeth 70 thereon corresponding in root diameter to teeth 48 provided on the cam drum ratchet; and, the masking ratchet also has a plurality of deep notches 72 spaced a desired multiple number of teeth 70. The function of the deep notches will be discussed hereinafter in greater detail.

Figure 5:
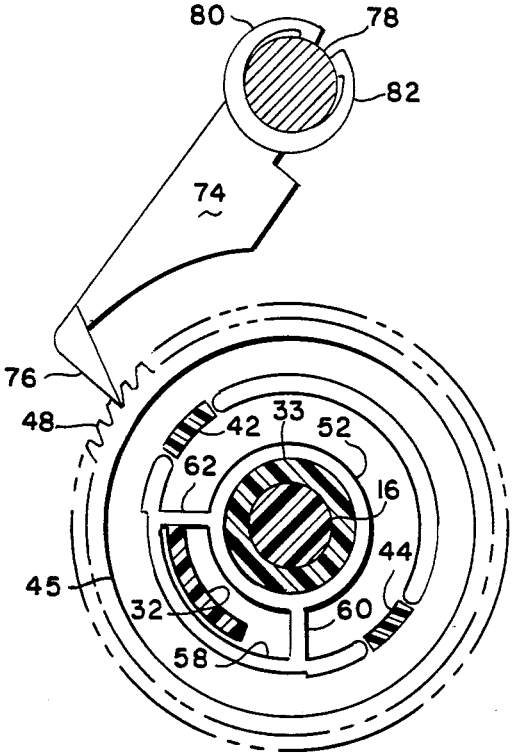
FIG. 5 is a portion of a section view taken along section-indicating lines 5—5 of FIG. 3.

Referring to FIGS. 2 and 5, the drive pawl 74 is shown as having a chisel point 76 engaging the teeth 48 of the cam drum 45, with the edge of the shaft lug 32 engaging the rib 62 in the interior of the hollow drum 45.

With continuing reference to FIGS. 2 and 5, the oscillating drive pawl 74 is shown as having the chisel point 76 thereof engaging with the ratchet teeth 48 and having the opposite end thereof received over an eccentric blade driven shaft 78 which powered through a speed reducer (not shown) by motor 14. The end of pawl 74 remote from the chisel point 76 is received over the eccentric shaft 78 by means of a pair of integrally formed arcuate spring fingers 80, 82 which serve to retain the pawl 74 journalled about the shaft 78.

It will be understood that the pawl point 76 engages teeth 48 when the drum 45 is positioned such that the teeth 48 are directly aligned with the point 76; and, in this arrangement the cam drum 45 is advanced one tooth for each stroke of the pawl which occurs in each revolution of the shaft 78.

When the cam drum 45 is initially positioned such that the teeth 50 of lesser diameter are disposed under the pawl point 76, the drum is advanced by one of the teeth 50 only when the pawl has dropped in one of the deep notches 72, which occurs only when the pawl has indexed the ratchet teeth 70 disposed between the deep notches. The teeth 50 thus provides a substantially slower rate of advance than the teeth 48.

Figure 6:
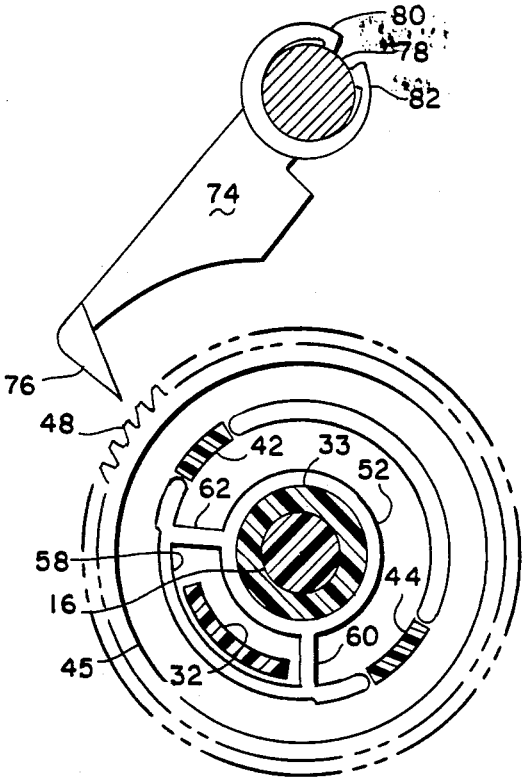
FIG. 6 is a portion of a section view taken along section-indicating lines 6—6 of FIG. 2.

Referring to FIGS. 3 and 6, the invention is illustrated with the shaft 16 being rotated by the user in lost motion such that the axial rib 32 on the shaft is intermediate the radial ribs 60, 62 on the cam drum and the helical surfaces 26 on the shaft are in engagement with the helical surfaces 38 and the annular member 34.

Referring to FIG. 3, the annular member 34 is shown in its axially downward-most position wherein the cam surface 40 has moved the advance pawl point 76 out of engagement with the ratchet teeth 48. When the annular cam member 34 is in the position shown in FIG. 3, an appliance user may freely rotate the shaft 16 in either direction for convenience of initial positioning of the cam drum 45.

The present invention thus provides a unique and novel electromechanical programmer/timer with a switch actuating cam drum sequentially advanced by a pawl and ratchet drive. The user-rotatable shaft for initially positioning the cam drum to select the program interval has helical cam surfaces thereon which move a conical cam ring axially to engage and lift the advance pawl out of engagement with the ratchet. The axial movement of the conical cam ring occurs during a limited amount of relative lost motion between the user rotated shaft and the cam drum. Thereafter, rotation of the shaft effects rotation of the cam drum.

Although the invention has hereinabove been described with respect to the illustrated embodiment, it will be understood that the invention is capable of modification and variation and is limited only by the following claims.

We claim:

1. A programmer/timer comprising:

(a) program cam means operable upon rotation about an axis to actuate and deactuate a plurality of switches in a programmed sequence;

(b) motorized advance means operable to advance said cam means for effecting said programmed sequence, said advance means including a ratchet and a periodically advancing pawl engaging said ratchet;

(c) positioning means user rotatable for effecting rotation of said program cam means to a desired position for program selection, said positioning means including engagement means operable to cause rotation of said cam means after a limited amount of rotational lost-motion between said positioning means and said program cam means; and, (d) release cam means disposed adjacent said positioning means and operable upon said rotational lost-motion of said positioning means to move axially from a first position enabling said advance pawl to engage said ratchet to a second position moving said pawl out of engagement with said ratchet for permitting rotation of said program cam means by said engagement means upon completion of said lost-motion movement.

2. The device defined in claim one, wherein said positioning means is disposed concentrically with respect to said axis of rotation of said program cam means.

3. The device defined in claim one, wherein said release cam means comprises an annular member having a tapered cam surface disposed about the periphery thereof, said cam surface operative to contact and lift said advance pawl during said axial movement from said first to said second position.

4. The device defined in claim one, wherein said positioning means has at least one helical surface thereon engaging a corresponding helical surface on said release cam means.

5. The device defined in claim one, wherein said release cam means comprises an annular member having a tapered cam surface disposed about the periphery thereof and said engagement means include a plurality of helical surfaces disposed in circumferentially spaced arrangement thereon.

6. The device defined in claim one, further comprising biasing means operative to resiliently urge said release cam means to said first axial position.

7. The device defined in claim one, further comprising friction means operable to provide a predetermined resistance to rotation of said cam means to affect said lost motion movement.

8. The device defined in claim one, wherein said ratchet wheel has a portion of the teeth thereof having a root diameter greater than the major diameter of the remaining teeth and further comprising masking means operable to block said pawl, for a selected multiple of pawl strobes, from contacting said remaining teeth for providing a reduced rate of advance of said cam means upon user positioning of said program cam means and ratchet for contact of said pawl with said remaining teeth.

* * * * *